United States Patent [19]

Kitajima et al.

[11] 4,081,233

[45] Mar. 28, 1978

[54] COMBUSTION DEVICE

[75] Inventors: Soichi Kitajima, Nara; Toshiyuki Ishiguro, Yamatokoriyama; Tadao Kanno, Kyoto; Katsuhiko Yamamoto, Nabari; Makoto Hori, Ikoma, all of Japan

[73] Assignee: Matsushita Electric Industrial Co., Ltd., Osaka, Japan

[21] Appl. No.: 638,604

[22] Filed: Dec. 8, 1975

[30] Foreign Application Priority Data

Jun. 19, 1975 Japan ..... 50-75131
Jun. 19, 1975 Japan ..... 50-75132

[51] Int. Cl.[2] ..... F23C 3/02

[52] U.S. Cl. ..... 431/1; 239/102; 431/183

[58] Field of Search ..... 431/1, 182, 183; 239/4, 239/102

[56] References Cited

U.S. PATENT DOCUMENTS

| | | | |
|---|---|---|---|
| 2,334,314 | 11/1943 | Campbell | 431/183 |
| 3,233,650 | 2/1966 | Cleall | 431/1 |
| 3,368,605 | 2/1968 | Reed | 431/183 X |
| 3,672,812 | 6/1972 | Bendixen | 431/183 X |
| 3,697,213 | 10/1972 | Eitrenberg | 431/79 |
| 3,796,536 | 3/1974 | Hori et al. | 431/1 |
| 3,861,852 | 1/1975 | Berger | 431/1 |
| 3,885,902 | 5/1975 | Fujieda et al. | 431/1 |
| 3,904,347 | 9/1975 | Rokudo et al. | 431/1 |

*Primary Examiner*—Edward G. Favors
*Attorney, Agent, or Firm*—Burgess, Ryan and Wayne

[57] ABSTRACT

A combustion device of the type for atomizing liquid fuel by an ultrasonic atomizer and mixing the atomized fuel particles with air for combustion. A first air passage is defined around a horn of the ultrasonic atomizer by an inner cylinder, and a second air passage is defined around the first air passage by the inner cylinder and an outer cylinder. The air flowing through the first air passage is discharged into a cylindrical combustion section substantially in parallel with the axis thereof while the air flowing through the second air passage is swirled in the direction substantially tangential to the inner wall of the combustion section and discharged toward the atomizing surface of the horn, whereby the satisfactory mixing of the atomized fuel particles with the combustion air may be attained and the flame may be optimumly stabilized.

22 Claims, 23 Drawing Figures

COMBUSTION DEVICE

BACKGROUND OF THE INVENTION

The present invention relates to a combustion device of the type in which liquid fuel is atomized for combustion by an ultrasonic atomizer.

The conventional combustion devices of the type for atomizing liquid fuel for combustion may be further divided into the following types;

(I) the combustion device incorporating the ultrasonic atomizer, (II) a gun type combustion device in which fuel is pressurized to the order of 7 kg/cm$^2$ by a gear pump or the like and then is atomized when injected through a nozzle, and (III) a rotary type combustion device in which liquid fuel is atomized by the centrifugal force produced by the rotation of a rotary disk or the like. The atomized fuel particles are mixed with the combustion air and burned. However, almost all of the conventional combustion devices of the type for atomizing the liquid fuel are not adapted for the low-rate combustion, for instance, the combustion at a rate less than 10,000 KCal/Hr. The reason is that the flame "blow-off" tends to occur so that the flame cannot be maintained in the stablized state, thus resulting in the incomplete combustion. In case of the gun type combustion device, the lower the combustion rate, the smaller the diameter of the nozzle hole must be made. However, in practice it is extremely difficult to drill such small diameter hole in the nozzle, and the small diameter nozzle hole tends to be clogged with foreign matter. Therefore, the conventional combustion devices of the type described can sustain the combustion only at a predetermined combustion rate. Furthermore the operation thereof for ignition, burning and extinguishing is controlled by the on-off control system. When the conventional combustion device is incorporated into a boiler for furnace in order to supply hot water or hot air of a predetermined temperature, the combustion device must be turned on and off at a short cycle so that the following problems arise:

(i) since the combustion device, the heat exhanger, the combustion chamber and other associated equipment or devices are repeatedly heated and cooled, they are subjected to thermal distortions and deformations, resulting in a short service life;

(ii) since the combustion device and its associated control unit are turned on and off very frequently, their service life is reduced, and (iii) since the temperature of the combustion chamber is low immediately after the ignition, the complete combustion cannot be expected at the initial stage. Therefore, when the turn-on and -off operations are cycled at a short cycle, the number of instances of incomplete combustion is increased, resulting in the increase in emission of smoke, soot and other pollutants such as carbon monoxide.

In the combustion device of the type including the ultrasonic atomizer, liquid fuel forms a very thin film upon the atomizing surface by the surface tension of the liquid fuel, and when the atomizing surface oscillates at an ultrasonic frequency, the thin film is broken so that the liquid fuel may be atomized into very finely divided particles. However, the kinetic energy of the atomized fuel particles is considerably lower than that of the particles atomized by other types of atomizers such as a pressure type atomizer. As a result, the atomized fuel particles cannot form the desired spray pattern and tend to descend under the influence of gravity immediately after they have left the atomizing surface. As a result, the density of the atomized fuel particles is considerably high in the vicinity of the atomizing surface. That is, the atomized fuel particles are not satisfactorily mixed with the combustion air in the ignition zone in a suitable ratio so that the ignitionability is adversely affected. Consequently, the pulsation and leap of flame occur, causing the combustion noise and adversely affecting the combustion. Since the atomized fuel particles have only considerably low kinetic energy, they are easily carried out by the combustion air with the result in the increase in unburned fuel.

In general, the nozzle, which is a part of the ultrasonic atomizer, is not adapted to satisfactorily atomize the liquid fuel regardless of its viscosity, surface tension and other properties. In order to atomize a large quantity of liquid fuel, the input must be increased because the thickness of liquid fuel film on the atomizing surface is increased. If the excessive input is applied, the thermal stresses are produced, causing the short service life.

The conventional combustion device incorporating the ultrasonic atomizer has a further defect that the mechanical oscillations of the ultrasonic transducer are transmitted to other parts, thus increasing the noise.

In order to overcome the above and other problems encountered in the prior art combustion devices incorporating the ultrasonic atomizer, there have been devised and demonstrated various improvements of the combustion device. Among these may be cited U.S. Pat. No. 3,275,059, Nozzle System and Fuel Oil Burner, granted to J. E. McCullough. However, the combustion rate of this fuel oil burner is constant. That is, the fuel oil burner cannot be selectively switched between the high and low combustion rates. In other words, it cannot control the thermal energy liberated by the combustion depending upon a demand. It has a further defect that the uniform supply of air cannot be ensured.

SUMMARY OF THE INVENTION

One of the objects of the present invention is therefore to provide a combustion device wherein the uniform mixing of atomized fuel particles with combustion air may be attained, whereby the complete combustion may be ensured.

Another object of the present invention is to provide a combustion device which may be selectively switched between the high- and low-rate combustions.

A further object of the present invention is to provide a combustion device which may sustain the optimum combustion even at such a low combustion rate as 4,000 KCal/Hr.

A further object of the present invention is to provide a combustion device which may be selectively switched between the high-rate combustion at a rate of, for instance, 15,000 KCal/Hr and the low-rate combustion at a rate of, for instance 4,000 KCal/Hr.

A further object of the present invention is to provide a combustion device which is started at a low combustion rate and after a predetermined time interval is switched to a high combustion rate.

A further object of the present invention is to provide a combustion device which may prevent the pulsation and oscillation of combustion caused by the abnormal increase in pressure in the combustion chamber in case of the ignition in the hot water boiler or furnace.

A further object of the present invention is to provide a combustion device which, in case of the ignition, may prevent the rapid temperature rise of the combustion chamber, the heat exchanger and other associated equipment or devices.

A further object of the present invention is to provide a combustion device in which the ultrasonic atomizer may be securely supported in a simple manner without causing any adverse effects on the operation of the ultrasonic atomizer.

A further object of the present invention is to provide a combustion device in which in addition to the screw joint between the oil or fuel passage formed in the horn of the ultrasonic atomizer and the fuel supply pipe, a suitable adhesive agent is applied to the threaded portions of both the fuel passage and the fule supply pipe, thereby ensuring the sufficient strength and liquid-tightness of the joint between them.

A further object of the present invention is to provide a combustion device in which the conditions of the flame in the combustion chamber may be directly viewed through a primary air passage from an inspection hole, and which incorporates flame sensor means very simple in construction.

A further object of the present invention is to provide a combustion device in which the ratio of the primary air to the secondary air may be easily determined by changing the opening area of the holes formed through a cylinder.

A further object of the present invention is to provide a combustion device in which the supporting system for the ultrasonic atomizer as well as the fuel supply system for supplying the fuel thereto are improved so that the combustion may be selectively switched between the high combustion rate and the low combustion rate, both rates being considerably lower than the combustion rate of the prior art combustion device.

To the above and other ends, the present invention provides a combustion device of the type for atomizing liquid fuel by an ultrasonic atomizer and mixing the atomized fuel particles with the combustion air for combustion, characterized by the provision of an ultrasonic atomizer supported by a supporting system and including an atomizing surface at which liquid fuel is atomized; a liquid fuel supply system adapted to supply liquid fuel to said atomizing surface; a primary air passage formed around said ultrasonic atomizer and opened at said atomizing surface; a secondary air passage in the form of a cylinder formed around said primary air passage and divided therefrom by partition wall means; an air supply system for supplying the air into said primary and secondary air passages; swirling means located in the vicinity of said atomizing surface and adapted to swirl the air flowing from said secondary air passage in the direction tangential thereto and to direct the swirling air to said atomizing surface; and a combustion section in which the air flowing out of said primary and secondary air passages and the atomized fuel particles are mixed, ignited and burned.

BRIEF DESCRIPTION OF THE DRAWING:

The same reference numerals are used to designate similar parts in FIGS. 3 through 23.

Figures 1, 2:
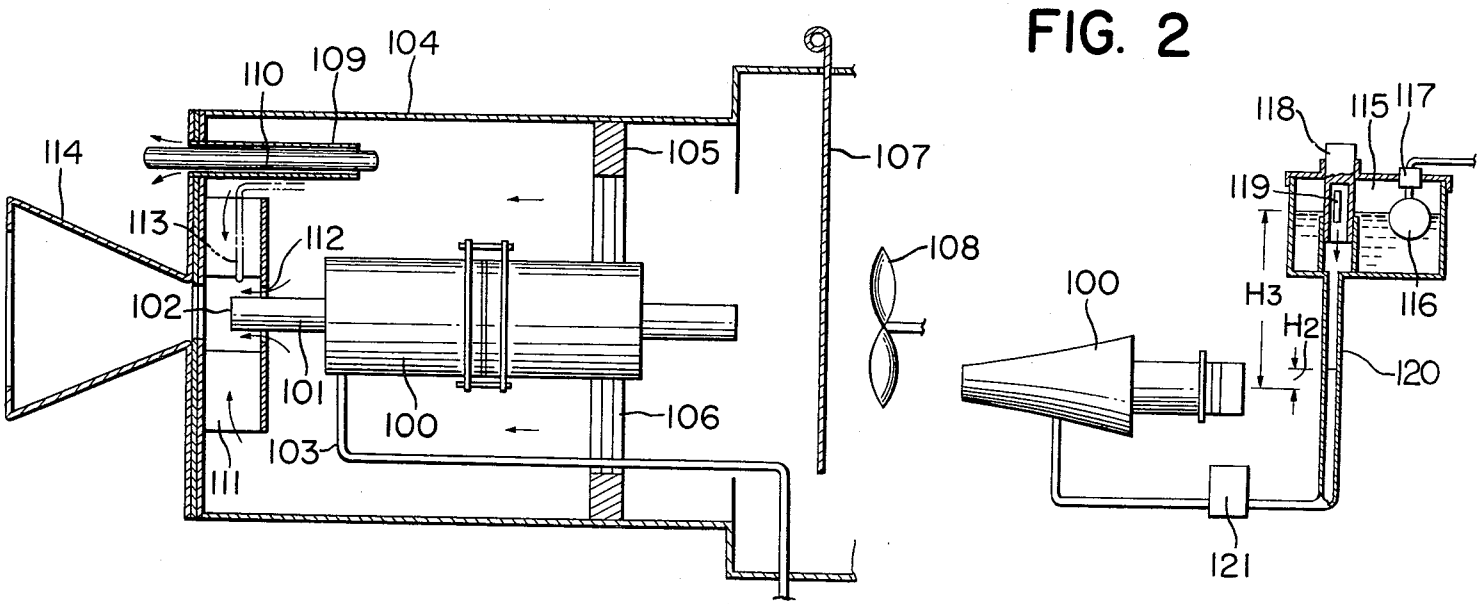
FIG. 1 is a sectional view of one example of the prior art combustion device.
FIG. 2 is a sectional view of one example of the prior art fuel supply system for the combustion device.

DESCRIPTION OF THE PREFERRED EMBODIMENT:

Prior Art, FIGS. 1 and 2

Prior to the description of one preferred embodiment of the combustion device in accordance with the present invention, one example of the prior art combustion devices will be briefly described in order to point out distinctly and specifically the problems thereof.

FIG. 1 is a schematic sectional view of an oil burner system disclosed in the above U.S. Pat. No. 3,275,059. Since this oil burner system is described in detail in the specification of the above U.S. patent, only those parts and arrangement required for the understanding of the present invention will be explained. As described above, this oil burner system cannot adjust the combustion rate. The ultrasonic atomizer 100 is supported within a forward housing 104, and the ratio of the axial flow to the tangential air flow is determined by suitably selecting the cross-sectional areas of the central opening 112 and the central section 111. The central opening 112 serves to direct the air flowing along the small-diameter section 101 in the axial direction, but in practice it is very difficult to locate the small-diameter section 101 in correctly coaxial relationship with the central opening 112 because of the dimensional errors of the parts introduced in the machining and assembly, especially the assembly of the supporting system for the ultrasonic atomizer 100. Consequently, the axial flow is not uniformly flowing out of the the annular passage between the central opening 112 and the small-diameter section 101 so that the local combustion, the incomplete combustion and the pulsating combustion result.

Since the electrode 113 is located within the central section 111, it contacts with the after plate or forward plate of the central section 111 even when the electrode 113 is displaced or deviated very slightly, causing the spark between the electrode 113 and the forward or after plate. As a result, the fuel and air mixture cannot be ignited. Furthermore the spark produced between the electrode 113 and the forward or after plate is very hazardous to the safe operation of the combustion device.

This combustion device has a further defect that the combustion condition cannot be directly viewed through the central opening 112 or the central section 111 so that the light pipe 110 is provided in order to detect the combustion condition in the combustion chamber. Such detection means is complex in construction, and it is more preferable to permit the direct observation of the combustion condition. Furthermore, from the standpoint of the combustion efficiency, it is not preferable to flow the cooling air through the passage between the light pipe 110 and its protective sleeve 109 and to discharge the cooling air into the combustion chamber.

The combustion air flowing in the housing 104 in the axial direction thereof is abruptly changed in direction to flow into the central section 111 to provide the tangential or swirling air flow. However, this arrangement has some defects that the kinetic energy of the air flow is lost when the air flow is abruptly changed in direction by 90°, and the air flow passing through the central section 111 inevitably includes the axial component.

Furthermore, the blast gate 107, the supporting system 106, the ultrasonic atomizer 100, the light pipe 110 and the electrode 113 exhibit considerable resistance to the axial air flow so that the air flow is deflected and the vortexes are formed. As a result, it is impossible to provide the completely streamlined tangential or swirling air flow so that the combustion is adversely affected.

The flow rate of the axial air flow is controlled by the cross-sectional area of the center opening 112 which is considerably small. When the position of the ultrasonic atomizer 100, which is supported by the supporting system 106 and the supporting ring 105, should be slightly deviated from its correct position, the small-diameter section 101 thereof is not located in correctly coaxial relationship with the central opening 112. As a result, the annular passage between the smaller-diameter section 101 and the central opening 112 is not uniform so that the axial air flow is not uniformly distributed and consequently the stabilized combustion cannot be ensured.

Since the electrode 113 is located in the central section 111, even the slightest displacement thereof from its correct position would cause the spark between the electrode 113 and the part surrounding it or the short-circuit. Therefore, the fuel and air mixture cannot be ignited, and the spark and short-circuit is hazardous to the safe operation of the combustion device.

The light pipe 110 is attached to the housing in order to permit the detection of the combustion condition, and a part of the combustion air is used to cool the light pipe 110 because the combustion cannot be directly viewed through the central opening 112 or central section 111.

The supporting system for the ultrasonic atomizer 100 has a greater influence upon the operation of the atomizer 100. In the prior art ultrasonic atomizers, they are supported at the node of oscillations thereof. The node is essentially a plane, but since the supporting system has a certain thickness, the mechanical oscillations of the atomizer are transmitted to the supporting system. Therefore, when the supporting system is rigidly held in position, the oscillations of the supporting system are restricted so that the oscillations of the atomizer are also restricted. Thus, the supporting system presents a load to the ultrasonic atomizer 100 so that the desired mechanical oscillations of the free end or atomizing surface of the horn 15 cannot be attained.

FIG. 2 shows one example of the prior art fuel supply system. A fuel metering device or float chamber 115 includes a float 116, a valve 117 actuated by the float 116 and a piston or plunger 118 provided with a slot 119. The metering device 115 is communicated through a tube 120 and a stop valve 121 with the ultrasonic atomizer 100. The flow rate of the fuel to be supplied is controlled by the opening degree of the slot 119. That is, during the combustion, a predetermined amount of fuel flows through the slot 119 into the fuel supply tube 120, and the fuel is supplied to the atomizer 100 under the head $H_2$. However, when the stop valve 121 is closed to interrupt the combustion, the level of the fuel in the fuel supply tube 120 rises to the level of fuel in the float chamber so that the fuel has a head $H_3$ relative to the atomizer 100. Therefore, when the stop valve 121 is opened again, the fuel is supplied to the atomizer 100 under the head $H_3$ so that the fuel supplied to the atomizer 100 is much increased in volume until the head is reduced to $H_2$ at which the fuel is supplied to the atomizer 100 at a predetermined rate. As a result, the atomizer 100 cannot sufficiently atomize the fuel, and too much fuel is supplied as compared with the combustion air and the volume of the combustion chamber.

To overcome this problem, there may be provided an electrically driven fuel pump, but the cost is increased.

The present invention was made to overcome the above problems.

The Invention

Figure 3:
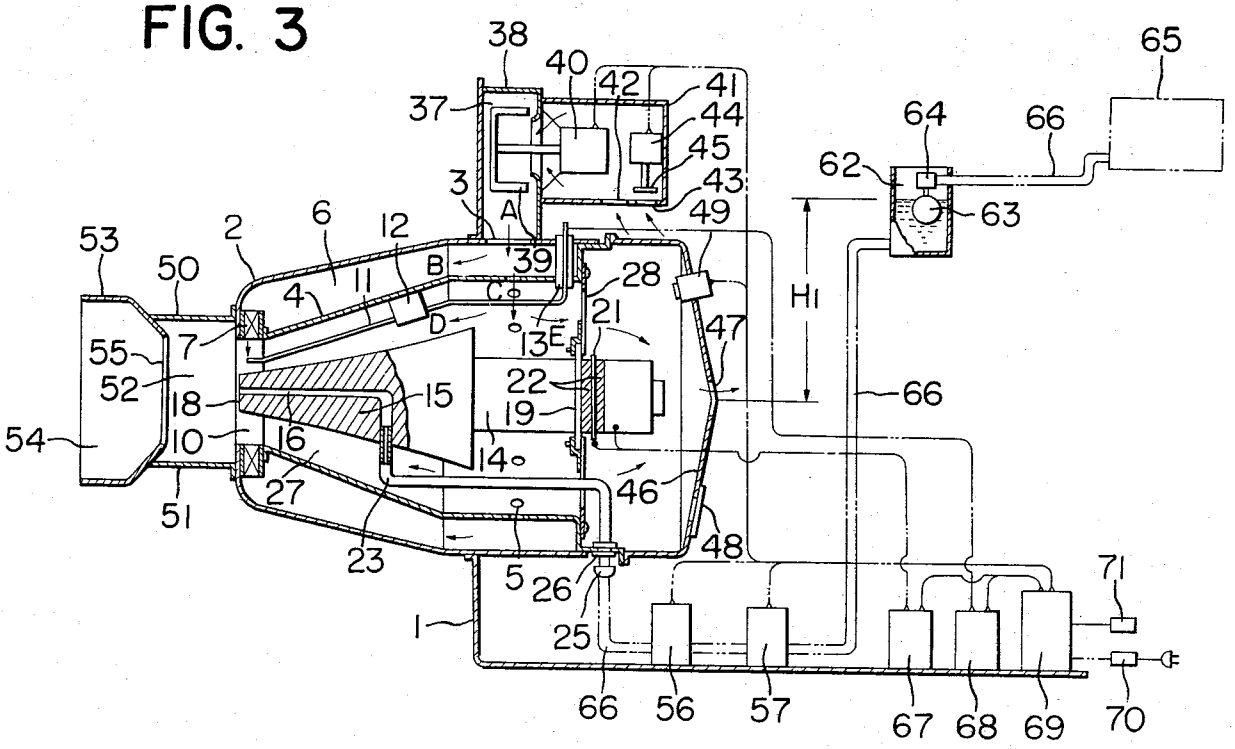
FIG. 3 is a sectional view of a combustion device in accordance with the present invention.
Figure 4:
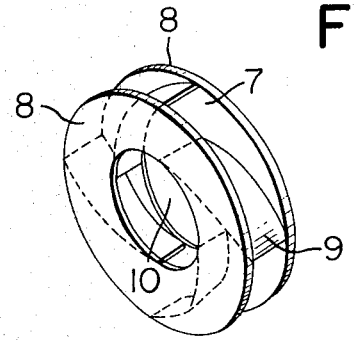
FIG. 4 is a perspective view of an air flow direction control means or air swirling means incorporated therein.

Referring to FIG. 3, an outer cylinder 2 U-shaped in cross section and with an air intake opening 3 is mounted upon a base plate 1. An inner cylinder 4 is provided with a plurality of holes 5, and is spaced apart from the outer cylinder 2 by a suitable distance so as to define an annular shaped secondary air passage 6. At the opening end of the secondary air passage 6 is attached an air flow direction control device or swirling means 7 with an opening 10 consisting of, as best shown in FIG. 4, two ring-shaped side plates 8 and a plurality of blades 9 interposed therebetween for directing the air flow in the tangential direction. Two ignition electrode rods 11 for producing the spark for ignition are supported by supporting members 12 and 13 made of an electrically insulating material. An ultrasonic atomizing device generally indicated by 14 comprises a horn 15 with an oil passage 16 extending coaxially thereof and with an atomizing surface 18, a flange 19 for supporting the atomizing device 14 and provided with a plurality of holes and an ultrasonic transducer consisting of crystals 22 sandwiching an electrode plate 21.

Figure 9:
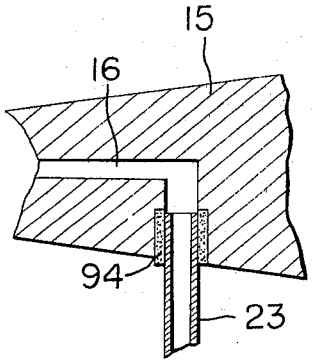
FIG. 9 is a veiw used for the explanation of the joint of the fuel supply pipe to the horn.
Figure 8:
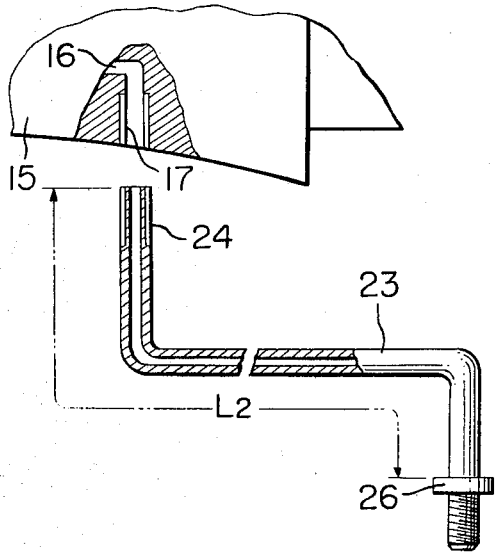
FIG. 8 is a side view, partly in section, of a fuel supply pipe connected to a fuel passage in a horn of the ultrasonic atomizer.

As best shown in FIG. 8, one end of an oil supply pipe 23 is externally threaded at 24 and screwed into an internally threaded hole 17 drilled in the horn 15 for communication with the oil passage 16, and the other end of the oil supply pipe 23 is supported by the inner cylinder 4 at the rear end thereof. When one end of the oil supply pipe 23 is screwed into the threaded hole 17, suitable adhesive is applied to them so as to ensure the liquid tightness of the joint. Alternatively, one end of the oil supply pipe 23 may be joined to the horn 15 in the manner shown in FIG. 9. That is, one end of the oil supply pipe 23 is fitted into the vertical hole in communication with the oil passage 16 of the horn, and an elastic ring 94 made of, for instance, rubber is interposed between the oil supply pipe 23 and the inner wall of the vertical hole. In assembly, suitable adhesive is applied to the oil supply pipe 23, the elastic ring 94 and the hole. Since the oil supply pipe 23 is elastically joined to the horn, it will not adversely affect the oscillations of the horn 15, and the liquid-tightness of the joint between the oil supply pipe 23 and the horn 15 may be ensured.

Referring back to FIG. 3, the other end of the oil supply pipe 23 is joined to a fuel supply tube 66 through a joint 25 and a nut 26.

A primary air passage 27 is defined between the ultrasonic atomizer 14 including the horn 15 and the inner cylinder 4.

Figure 5:
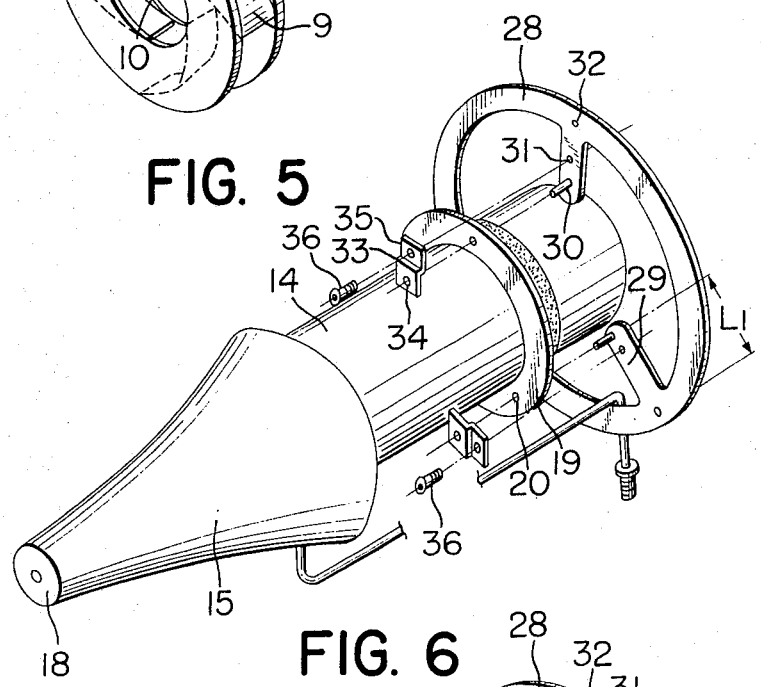
FIG. 5 is an exploded perspective view of a supporting system for an ultrasonic atomizer thereof.

Referring to FIG. 5, the ultrasonic atomizer 14 is attached to the rear end of the inner cylinder 4 with a ring-shaped supporting member 28 with a plurality of radially inwardly extended supporting arms 29 each provided with a pin 30 extended axially from the free end thereof. In assembly, the pins 30 of the supporting arms 29 of the supporting member 28 are fitted into the mating holes 20 of the supporting flange 19 and the holes 34 of pressure plates 33 made of an elastic material. Thereafter, a screw 36 is screwed into the hole 35 of the pressure plate 33, the hole 20 of the flange 19 and the screw hole 31 of the supporting arm 29, whereby the ultrasonic atomizer 14 may be securely attached to the supporting member 28 which in turn is securely attached to the rear end of the inner cylinder 4 with screws (not shown) screwed into the holes 32 of the supporting member 28 and the screw holes (not shown) drilled in the inner cylinder 4.

Figure 6:
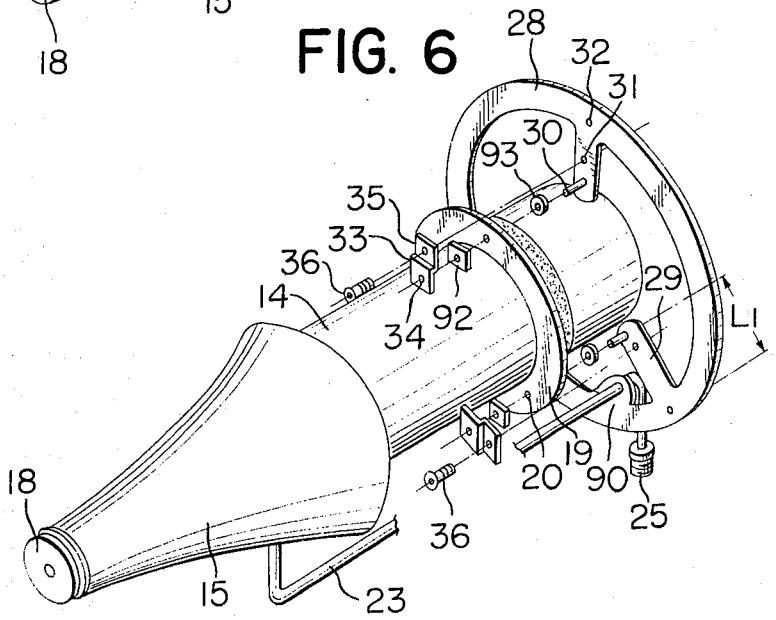
FIG. 6 is a view similar to FIG. 5 illustrating a modification of the supporting system.

As shown in FIG. 6, an elastic washer 92 may be fitted over the screw 36 and interposed between the pressure plate 33 and the supporting flange 19. In like manner, a suitable washer 93 is fitted over the pin 30 and interposed between the supporting flange 19 and the supporting member 28. This arrangement is advantageous in that the mechanical oscillation of the horn 15 may be absorbed by the elastic washers 92 so that the oscillations are not transmitted to the inner cylinder 4. It should be noted that the screw 36 is merely passed through the hole 20 of the flange 19 and does not make any threadable engagement therewith so that the transmission of the oscillations of the horn 15 to the inner cylinder 4 may be prevented to some extent.

In the arrangement shown in FIG. 6, the fuel supply pipe 23 is supported by a supporting member 90 formed integral of the supporting member 28 so that the undesired vibrations of the fuel supply pipe 23 may be prevented and consequently the adverse effect on the joint between the horn 15 and the fuel supply pipe 23 due to the vibrations of the latter may be eliminated.

Figure 7:
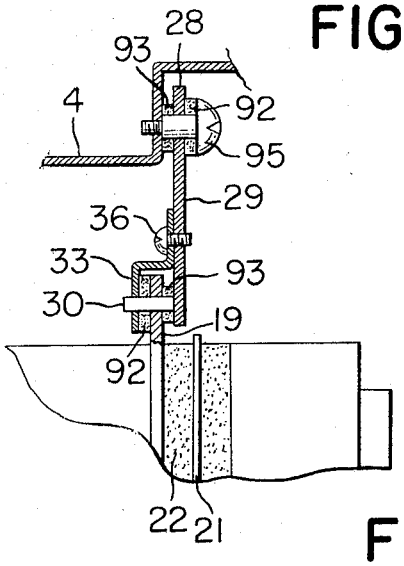
FIG. 7 is a side view, on enlarged scale, of the supporting system shown in FIG. 4.

FIG. 7 shows the attachment of the supporting member 28 with screws 95 to the rear end of the inner cylinder 4.

Referring back to FIG. 3, reference numeral 37 denotes a blower system or air supply system for supplying the combustion air including a casing 38, an impeller 39, a motor 40, a guide inner cylinder 41, air inlets 42 and 43, a solenoid 44 and a damper 45. The combustion air flows through the air inlets 42 and 43 and the air intake opening 3 of the outer cylinder 2 into the secondary air passage 6. The solenoid 44, the damper 45 and the air inlets 42 and 43 constitute a device for controlling the flow rate of the combustion air. In case of the high combustion rate, the solenoid 44 is energized to actuate the damper 45 to open the air inlet 43. As a result, the air flows into the blower system 37 both through the air inlets 42 and 43. On the other hand, in case of the low combustion rate, the solenoid 44 is deenergized to close the air inlet 43 so that the air flows into the system only through the air inlet 42.

A cover 46 attached to the rear end of the outer cylinder 2 has an air discharge opening 47, a window 48 through which is inspected the flame of combustion and a flame detector 49 such as CdS.

A combustion cylinder 50 includes a primary combustion cylinder 51 attached to the air flow control device 7 and a secondary combustion cylinder 53 attached to the primary combustion cylinder 51 and having an outer diameter greater than that of the primary combustion cylinder 51. The primary combustion cylinder 51 defines a primary combustion chamber 52 while the secondary combustion cylinder 53, a secondary combustion chamber 54 communicated with the primary combustion chamber 52 through an opening 55 whose diameter is smaller than the inner diameter of the primary combustion chamber 52.

Figure 10:
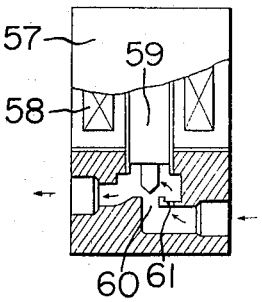
FIG. 10 is a sectional view of a solenoid operated flow control valve in a fuel supply system.

In the fuel supply tube 66 are inserted a solenoid operated stop valve 56 and a solenoid operated flow control valve 57, which, as shown in FIG. 10, includes a solenoid 58, a plunger 59, a main passage 60 and a small hole which serves as an auxiliary passage 61. The stop valve 56 is similar in construction to the flow control valve 57 except the former is not provided with the auxiliary passage 61. The fuel supply tube 66 is communicated with a fuel tank 65 through a float chamber 62 consisting of a float 63 and a valve 64. The fuel flows through the fuel supply tube 66 under the gravity into the floating chamber 62 through the valve 64. When the level of the fuel in the float chamber 62 reaches a predetermined level, the float 63 rises to close the valve 64 so that the fuel supply may be interrupted. Therefore, the surface level of the fuel in the floating chamber 62 may be always maintained at a predetermined level. The fuel supply system is of the gravity feed type in which the floating chamber or oil reservoir 62 is located at a position higher than the ultrasonic atomizer 14 so that the head is $H_1$ and the fuel tank 65 is located higher than the floating chamber or oil reservoir 62.

The quantity of fuel to be supplied to the atomizing surface 18 of the horn 15 is controlled in the following manner. First, in case of the low combustion rate, the stop valve 56 is opened, so that the fuel supply may be determined depending upon the resistance of the passage in the stop valve 56, the auxiliary passage 61 in the flow control valve 57 and the oil line from the oil reservoir 62 to the atomizing surface 18 and the head $H_1$. In case of the high combustion rate, the flow control valve 57 is opened to open its main passage 60 so that the fuel supply is dependent upon the whole resistance of the fuel supply tube 66 and the head $H_1$.

The combustion device further includes an ultrasonic oscillator 67 for driving the ultrasonic transducer 22, a transformer 68 for supplying a high voltage to the ignition electrode rods 11; a control unit 69 for automatically controlling the combustion condition; an operation switch 70 and a switch 71 for selecting the high or low combustion rate. In FIGS. 11 through 14, reference numerals 72 and 73 denote the flames.

Figure 15:
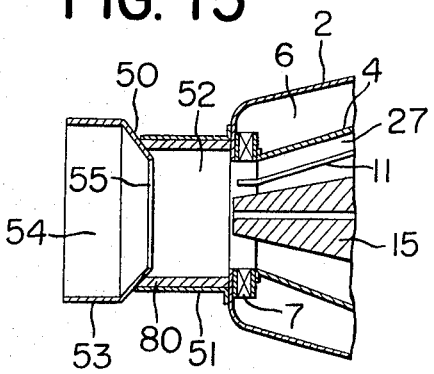
FIGS. 15 and 16 show modifications of a combustion section.
Figure 16:
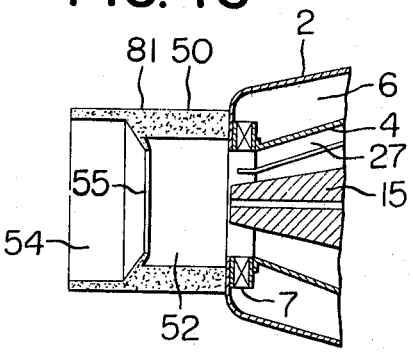
Figure 17:
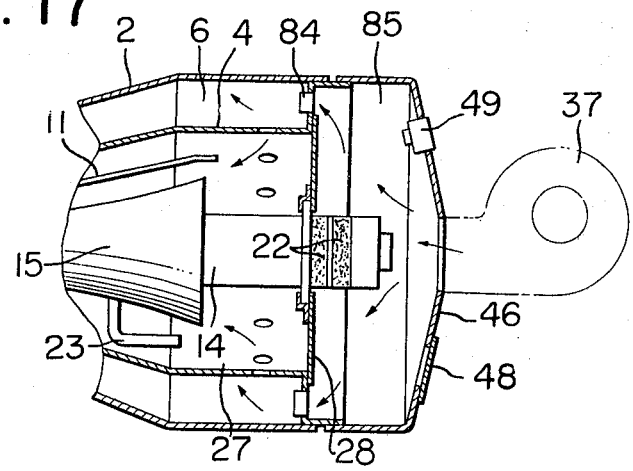
FIG. 17 is a schematic sectional view illustrating a modification of an air supply system.
Figure 18:
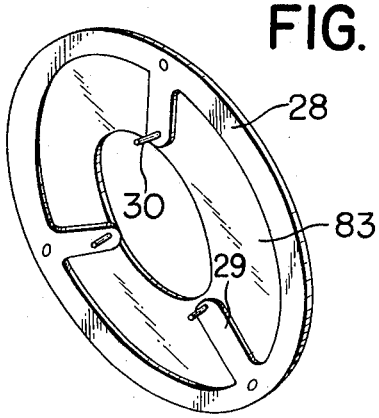
FIG. 18 is a perspective view of a supporting member of the supporting system for the ultrasonic generator used in the modification shown in FIG. 17.
Figure 19:
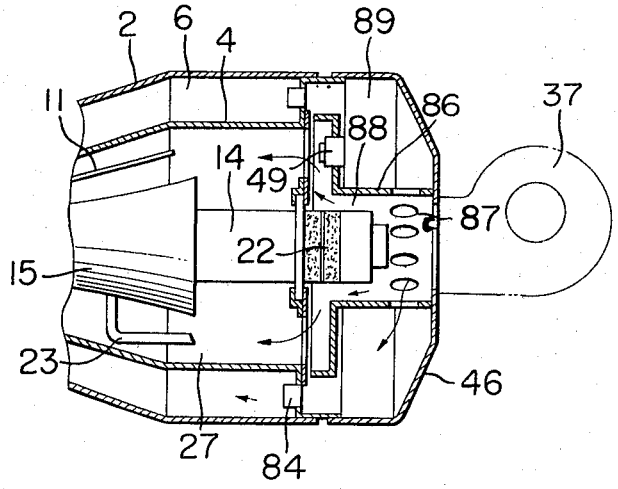
FIGS. 19 and 20 are views of modifications of the air supply system.
Figure 20:
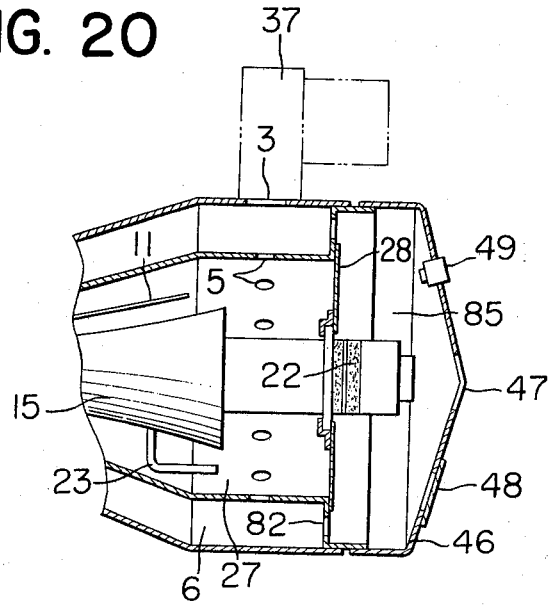

FIGS. 15 through 22 show the partial modifications of the combustion device in accordance with the present invention. In FIG. 15, the inner wall of the primary combustion cylinder 51 of the combustion cylinder 50 is lined with a refractory layer 80 such as ceramic. In FIG. 16, the combustion cylinder 50 is made of a suitable refractory material such as ceramic. The arrangements for cooling the ultrasonic transducer 22 are shown in FIGS. 17 through 20. In the arrangement shown in FIG. 17, the supporting member 28 defines the primary air passage 27 and a cooling chamber 85 into which flows the air from the blower system 37 in order to cool the ultrasonic transducer 22. From the cooling chamber 85, the cooling air is introduced into the secondary air passage 6 and flows in the direction indicated in FIG. 3 as the primary and secondary air. An air flow control means 84 is located between the cooling chamber 85 and the secondary passage 6 so that the air discharged from the cooling chamber 85 may be directed in the tangential direction. FIG. 18 is a perspective view of the supporting member 28 used in the arrangements shown in FIGS. 17 and 20 and provided with a transparent member 83 in order to prevent the passage of the air through the supporting plate 28. In the arrangement shown in FIG. 20, the supporting member 28 defines the primary air passage 27 and the cooling chamber 85 as with the case of the arrangement shown in FIG. 17. The blower system 37 forces the air into the secondary air passage 6 through the air intake opening 3 of the outer cylinder, and a portion of the air introduced into the secondary air passage 6 flows into the cooling chamber 85 through holes 82. From the cooling chamber 85, the cooling air is discharged through the discharge hole 47 of the cover 46. In the arrangement shown in FIG. 19, a cylindrical guide section 86 is located between the rear end of the inner cylinder 4 and the cover 46 so as to surround the ultrasonic transducer 22 and to define the passages 88 and 89. The passage 88 is communicated with the primary air passage 27 while the passage 89, with the secondary air passage 6. The air flowing from the blower system 37 flows into the passages 88 and 89. The air flowing into the passage 88 cools the ultrasonic transducer 22 and is discharged into the primary air passage 27.

Figure 21:
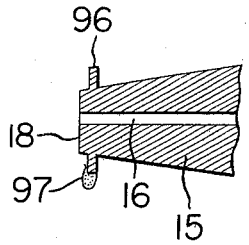
FIG. 21 is a fragmentary sectional view of a modification of the horn of the ultrasonic atomizer.
Figure 22:
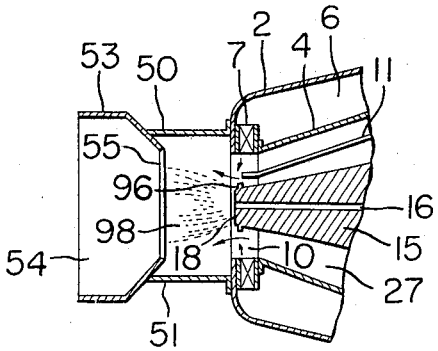
FIG. 22 is a view illustrating the horn shown in FIG. 21 assembled in the combustion device.

Referring to FIG. 21, an annular flange 96 is formed in the vicinity of the atomizing surface 18 of the horn 15. The fuel supplied through the fuel passage 16 to the atomizing surface 18 adheres to the fuel trapping flange 96 as indicated by 97. That is, the flange 96 serves to prevent the fuel from flowing along the outer surface of the horn 15. FIG. 22 shows the horn 15 with the flange 96 incorporated in the combustion device.

Next the mode of operation of the combustion device with the above construction will be described. Referring to FIG. 5, let $L_1$ denote the length between the center of the hole 20 of the flange 19 and the center of the hole 32 of the supporting member 28; let $f$ denote the oscillation frequency; let $c$ denote the speed of sound in the supporting arm 29; and let $\lambda$ the wavelength of sound propagating through the arm 29. Then, the wavelength $\lambda$ is given by $$\lambda = C/f \tag{1}$$

When the attenuation in the arm 29 is negligible and let $l$ denote the distance from the center of the hole 32 of the supporting member 28, then the speed distribution in the arm 29 is given by $$v = V_{max} \sin 2\pi l/\lambda \tag{2}$$

In order to make V maximum when $l = L$, the following condition must be satisfied:

$$\sin (2\pi/\lambda)L_1 = \pm 1 \tag{3}$$

That is, $$(2\pi/\lambda)L_1 = (2n - 1)\pi/2 \tag{4}$$

where $n = 1, 2, \ldots$
and $$L_1 = \lambda/4\,(2n-1) \tag{5}$$

Therefore, when the length $L_1$ is an odd integer of $\lambda/4$, the arm 29 oscillates at a resonant frequency. Therefore, the arms 29 present no load to the horn 15. Thus, the problem encountered in the prior art combustion devices may be overcomed.

As described above, in the present embodiment, one end of the fuel supply pipe 23 is joined to the horn 15 while the other end thereof is attached to the inner cylinder 4. In the conventional devices, the fuel supply line was joined to the node point of the horn, but since the pipe 23 has its own weight and volume, the oscillations of the horn 15 are transmitted thereto, resulting in the problem described above as with the case of the support of the atomizer 14.

Let $L_2$ denote the distance between the joint between the pipe 23 and the horn 15 and the joint 25 at which the other end of the fuel supply pipe 23 is supported; let $f$ denote the oscillation frequency of the oscillation system; let denote $c$ the speed of sound in the fuel pipe 23; let $\lambda$ the wavelength of the sound travelling through the pipe 23; and let $l$ denote the distance from the joint 25 to the joint between the pipe 23 and the horn 15. Then from Eqs. (1) through (5), it is found that when the length $L_2$ is an odd integer of $\lambda/4$, the pipe 23 oscillates at the resonant frequency so that it presents no load to the horn. Thus, the above problem may be overcomed.

Next the mode of combustion will be described. The combustion device in accordance with the present invention may be selectively switched to the high or low combustion rate. Therefore, first the combustion at a low rate will be described.

Referring to FIG. 3, the operation switch 70 is turned on to actuate the control unit 69. Then the blower system 37 is energized so that the air is sucked through the air inlet 42 and flows through the air intake opening 3 in the direction tangential to the inner surface of the outer cylinder 2 as indicated by the arrow A. The air swirls in the secondary air passage 6 and flows in the direction indicated by the arrow B and is injected into the opening 10 after it has been streamlined by the air flow control device 7. The air A also flows through the openings 5 of the inner cylinder 4 into the primary air passage 27 as indicated by the arrow C, and is divided into the primary air flowing through the passage 27 in the direction indicated by the arrow D and the air flowing in the direction indicated by the arrow E (opposite to the direction D) for cooling the transducer. The air flow D flows along the horn 15 to cool the same and is discharged into the opening 10 of the air flow control device 7 as the primary combustion air.

The transformer 68 supplies a high voltage to the two electrodes 11 to produce the spark. The ultrasonic generator 67 is energized to drive the ultrasonic transducer 22 and hence the ultrasonic atomizer 14.

The stop valve 56 is opened so that the fuel is supplied to the atomizing surface 18 of the horn from the oil reservoir 62 through the fuel supply tube 66, the auxiliary passage 61 in the control valve 57, the stop valve 56, the fuel supply pipe 23 and the fuel passage 16 in the horn 15. The fuel is atomized at the atomizing surface and the atomized fuel particles are discharged.

The above operations are concurrently actuated. Therefore the combustion mixture is ignited whereby the low-rate combustion may be started. A time after the combustion is started, the ignition electrode rods 11 are de-energized. The flame detector 49 is adapted to interrupt the operation of the combustion device in case of a mis-fire or the like. Thereafter, the starting operation described above may be automatically repeated.

To switch to the high-rate combustion, the selection switch 71 is switched to "HIGH" so that both the solenoid 58 of the control valve 57 and the solenoid 44 of the guide section 41 are energized simultaneously. Therefore the plunger 59 of the control valve 57 is lifted so that the main passage 60 is opened. As a result, the flow rate of the fuel flowing through the fuel supply tube 66 is increased. The damper 45 is lifted when the solenoid 44 is energized so that the air inlet 43 is opened. As a result, the air intake is increased.

To switch the high-rate combustion to the low-rate combustion, the selection switch 71 is switched to "LOW".

The fuel quantity and the intake air are so selected that the complete combustion may be ensured.

Figure 11:
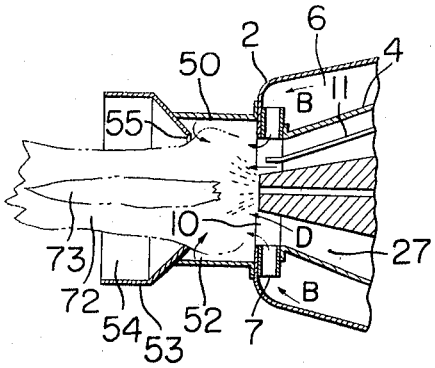
FIGS. 11 and 12 are views used for the explanation of the combustion conditions.
Figure 12:
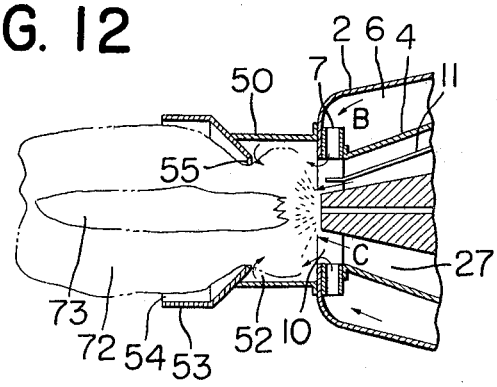

The combustion conditions are shown in FIGS. 11 and 12. The combustion air consists of the primary air D flowing along the outer surface of the horn 15 of the ultrasonic atomizer 14 and the secondary air flowing through the annular secondary air passage 6 and suitably swirled by the air flow control device 7. The secondary air flows into the opening 10 of the air flow direction control device 7 and then flows through the primary and secondary combustion chambers 52 and 63. The atomized fuel particles from the atomizing surface 18 of the horn 15 are with the strong swirling secondary air in the first combustion chamber 52 and burned in the form of the outer swirling flame 72. The combustion heat rapidly heats the combustion section 50 so that the vaporization of the atomized fuel particles may be much facilitated in the primary combustion chamber 52. Therefore the ignition and combustion of fuel may be much facilitated.

Since the communication passage between the primary and secondary combustion chambers 52 and 54 is restricted the small-diameter opening 55, a portion of the mixture consisting of the secondary air and the atomized fuel particles produces small vortexes in the vicinity of the opening 55, and the mixture remains in the primary combustion chamber 52 for a longer time so that the mixing and combustion may be much facilitated.

Since the swirling flame 72 tends to expand outwardly under the influence of the centrifugal force, the pressure at the center drops. At the center a portion of the atomized fuel particles and the primary air D mix with each other, thus forming a center flame 73.

Under the influence of the swirling flame 72, the center flame 73 swirls at a relatively slow speed, whereby the flame holding effect may be produced.

In case of the low-rate combustion shown in FIG. 11, the flame is spaced apart from the inner surface of the secondary combustion chamber 54, but in case of the high-rate combustion shown in FIG. 12, the flame extends along the inner wall of the second combustion chamber 54. The secondary combustion cylinder 53 has the function of preventing the flame passing through the restricted opening 55 from expanding outwardly. Therefore, the flame may be streamlined and the complete combustion may be ensured.

In case of the low-rate combustion, the air intake is decreased. In the present embodiment, the secondary air which is swirling as it passes through the secondary air passage 6, is subjected to the further swirling action by the air flow direction control device 7. Therefore, the satisfactory complete combustion may be ensured both at a high- and low-rate combustion.

FIGS. 15 and 16 show the modifications of the combustion section. The complete combustion may be carried out even when the combustion section is lined with the refractory member or is made of a refractory material such as ceramic as described hereinbefore. Furthermore these modifications are advantageous in that the thermal distortions of the combustion section may be positively prevented.

Figure 13:
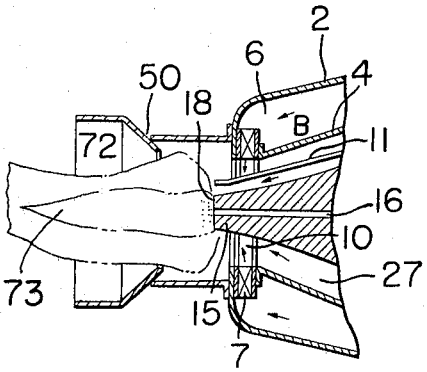
FIGS. 13 and 14 are views used for the explanation of how the position of the front end of the air flow direction control device relative to the atomizing surface of the horn will affect the combustion.

In the present embodiment, the air flow direction control device 7 is so located that the surface of the front end thereof may be in coplanar relationship with the atomizing surface 18 of the horn 15 so that the better combustion may be ensured. The relative position between the air flow direction control device 7 and the atomizing surface 18 of the horn is very important because of the reasons to be described hereinafter. In FIG. 13, the atomizing surface 18 is extended beyond the front end of the air flow direction control device 7 into the combustion cylinder 50. Under this condition, the atomized fuel particles from the atomizing surface 18 are immediately turned into the flames 72 and 73 wich contact with the tips of the ignition electrode rods 11. As a result, the electrodes 11 are overheated, resulting in the short service life. Furthermore, the heat is transmitted through the horn 15 to the ultrasonic transducer 22 located at the end of the horn 15, thereby adversely effecting the operation of the ultrasonic transducer 22. Moreover, carbon and tar tend to adhere to the ignition electrode rods 11, causing the non-ignition. Since the flame is produced before the atomized fuel particles and combustion air are satisfactorily mixed, the combustion characteristics are not satisfactory.

Figure 14:
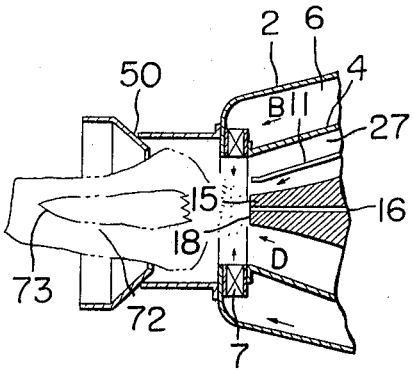

In FIG. 14, the atomizing surface 18 is shown as being located behind the front end of the air flow direction control device 7. This results in the increase in distance between the atomizing surface 18 and the ignition zone. As a result, the mixing of the atomized fuel particles and combustion air is not stable so that the flame blow-off tends to occur very frequently. Furthermore, the atomized fuel particles adhere to the inner cylinder 4 and are accumulated as droplets which flow backwardly along the surface of the inner cylinder 4.

This will adversely affect the safe operation of the combustion device.

Figure 23:
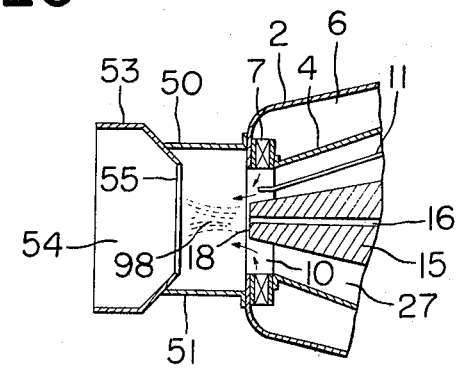
FIG. 23 is a view used for the explanation of the advantage of the modified horn shown in FIGS. 21 and 22.

FIG. 22 shows the horn 15 with the flange 96 formed in the vicinity of the atomizing surface 18, so that the air flowing out of the primary air passage 27 serves to prevent the flame 98 from being restricted as shown in FIG. 23. The restriction of the flame shown in FIG. 23 is observed when the large amount of the combustion air is supplied in order to attain the high-rate combustion. In FIG. 22, the flame is maintained in a stable manner, and the satisfactory mixing of the atomized fuel particles with the combustion air may be attained so that the complete combustion may be ensured. The flange 96 further serves to form the droplet 97 which breaks the film of fuel formed upon the atomizing surface 18. Therefore, at the start of the combustion, no oil film is formed upon the atomizing surface 18, whereby the atomization may be much facilitated.

So far the combustion device in accordance with the present invention has been described as being switched between the high or low rate combustion, but it is to be understood that the infinitesimal adjustment of the combustion rate may be provided by the proportional control of the air intake and fuel supply.

What is claimed is:

1. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means; and adapted to swirl the air flowing from said secondary air passage in a direction tangential to the air flowing in said primary air passage, said swirling means comprising first swirling means for swirling the air in the direction tangential to said secondary passage, and second swirling means located at the discharge end of said secondary air passage for directing the swirling air to said atomizing surface; and (g) a combustion section in which the air flowing out of said primary and secondary air passages and the atomized fuel particles are mixed, ignited and burned.

2. A combustion device as set forth in claim 1 further comprising means for introducing the air into said primary and secondary air passages in a predetermined volume ratio, said introducing means comprising holes formed through a partition wall dividing said primary and secondary air passages.

3. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially said entire ultrasonic atomizer and opend at said atomizing surface;

(d) a secondary air passage in the form of a cylinder formed around substantially said entire primary air passage and opened at the vicinity of said atomizing surface and divided thereform by a partition wall;

(e) an air supply system for supplying the air into said primary and secondary air passages and for forcing the air in both said air passages to flow toward the vicinity of said atomizing surface through said passages, said air supply system comprising means for supplying air for cooling an ultrasonic transducer means of said ultrasonic atomizer, said cooling air supply means comprising means for causing the cooling air to flow in the direction opposite to the direction of the air flowing forwardly along said ultrasonic atomizer;

(f) swirling means located in the vicinity of said atomizing surface and attached to an end of said partition wall means; and adapted to swirl the air flowing form said secondary air passage in a direction tangential to the air flowing in said primary air passage; and (g) a combustion section in which the air flowing out of said primary and secondary air passages and the atomized fuel particles are mixed, ignited and burned.

4. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages, said air supply system comprising means for supplying air for cooling an ultrasonic transducer means of said ultrasonic atomizer, said cooling air supply means comprising means for introducing the cooling air into a chamber in which is located said transducer means;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned.

5. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages, said air supply system comprising means for charging cooling air into a chamber where an ultrasonic transducer means of said ultrasonic atomizer is located and then for discharging said cooling air from said chamber into said primary and secondary air passages;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned.

6. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substnatially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned, wherein a fuel passage is formed through said ultrasonic atomizer and one end of said fuel passage is opened at said atomizing surface; the other end of said fuel passage is internally threaded; and one end of a fuel line of said fuel supply system is externally threaded for threadable engagement with said other end of said fuel passage, adhesive being applied to said externally threaded end of said fuel line and to said internally threaded end of said fuel passage whereby said fuel line may be liquid-tightly joined to said fuel passage in said ultrasonic atomizer.

7. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned, wherein a fuel passage is formed through said ultrasonic atomizer and one end of said fuel passage is opened at said atomizing surface; and one end of a fuel line of said fuel supply system is fitted into the other end of said fuel passage with an elastic ring means interposed between said one end of said fuel line and the inner wall of said fuel passage at said other end thereof.

8. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized, said supporting system comprising a supporting flange provided with a plurality of holes and formed integral with said ultrasonic atomizer, a supporting member with a plurality of supporting arms each provided with a pin adapted to be fitted into said hole of said supporting flange, and a plurality of pressure members so positioned as to sandwich said supporting flange with said supporting member;

(b) a liquid fuel supply system adapted to supply liquid fuel to said atomizing surface;

(c) a primary air passage formed around substantially said entire ultrasonic atomizer and opened at said atomizing surface;

(d) a secondary air passage in he form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned.

9. A combustion device of the type for atomizing liquid fuel by an ultrasonic atomizer and mixing the atomized fuel particles with the air combustion, comprising (a) an ultrasonic atomizer supported by a supporting system and including an atomizing surface at which liquid fuel is atomized, said ultrasonic atomizer comprising an oscillation amplifying horn, and an ultrasonic transducer attached to said horn, said atomizing surface being the free end of said horn, and an annular flange or ridge formed around the side wall of said horn in the vicinity of said atomizing surface and spaced apart from said atomizing surface by a predetermined distance;

(b) a liquid fuel supply system adapted to supply liquid fuel to said atomizing surface;

(c) a primary air passage formed around substantially said entire ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means; and adapted to swirl the air flowing from said secondary air passage in a direction tangential to the air flowing in said primary air passage; and (g) a combustion section in which the air flowing out of said primary and secondary air passages and the atomized fuel particles are mixed, ignited and burned.

10. A combustion device as set forth in claim 1 including first air swirling means adapted to direct the air from the exterior of said secondary air passage into the same in the direction tangential thereto, thereby swirling the air.

11. A combustion device as set forth in claim 1 wherein said first swirling means includes air swirling members thereby swirling the air flowing into said secondary air passage.

12. A combustion device of the type for atomizing liquid fuel by an ultrasonic atomizer and mixing the atomized fuel particles with the air for combustion, comprising (a) an ultrasonic atomizer supported by a supporting system and including an atomizing surface at which liquid fuel is atomized;

(b) a liquid fuel supply system adapted to supply liquid fuel to said atomizing surface;

(c) a primary air passage formed around substantially the entire length of said ultrasonic atomizer and opened at said atomizing surface;

(d) a secondary air passage in the form of a cylinder formed around substantially said entire primary air passage and opened at the vicinity of said atomizing surface and divided therefrom by a partition wall;

(e) an air supply system for supplying the air into said primary and secondary air passages and for forcing the air in both said air passages to flow toward the vicinity of said atomizing surface through said passages;

(f) swirling means located in the vicinity of said atomizing surface and attached to an end of said partition wall means, and adapted to swirl the air flowing from said secondary air passages in a plane substantially transverse to the path of the air flowing in said primary air passage; and (g) a combustion section in which the air flowing out of said primary and secondary air passages and the atomized fuel particles are mixed, ignited and burned.

13. A combustion device as set forth in claim 12 wherein the surface of the front end of said swirling means is located in coplaner relationship with said atomizing surface.

14. A combustion device as set forth in claim 12 further comprising means for introducing the air into said primary and secondary air passages in a predetermined volume ratio.

15. A combustion device as set forth in claim 12 wherein said primary air passage is defined between said ultrasonic atomizer and an inner cylinder surrounding said ultrasonic atomizer; and said secondary air passage is defined between said inner cylinder and an outer cylinder surrounding said inner cylinder.

16. A combustion device as set forth in claim 12 wherein the dimensions of said primary air passage is such that the vicinity of said atomizing surface may be directly viewed through said primary air passage from a flame sensor means located behind said ultrasonic atomizer.

17. A combustion device as set forth in claim 12 wherein the inner wall surface of said combustion section is lined with a refractory layer.

18. A combustion device as set forth in claim 12 wherein said combustion section is made of a refractory material as a unit.

19. A combustion device as set forth in claim 12 wherein said air supply system comprises means for supplying air for cooling an ultrasonic transducer means of said ultrasonic atomizer.

20. A combustion device as set forth in claim 8 wherein an elastic member is interposed between said pressure member and said supporting flange, and is provided with a hole through which said pin is extended.

21. A combustion device of the type for atomizing liquid fuel by an ultrasonic atomizer and mixing the atomized fuel particle, with the air for combustion, characterized by the provision of (a) an ultrasonic atomizer supported by a supporting system and including an atomizing surface at which liquid fuel is atomized;

(b) a liquid fuel supply system adapted to supply liquid fuel to said atomizing surface and comprising a fuel reservoir located above said ultrasonic atomizer and having a predetermined head relative thereto, and a fuel line including valve means interconnected between said fuel reservoir and said ultrasonic atomizer, whereby the amount of liquid fuel to be supplied to said ultrasonic atomizer may be determined by the resistance of said fuel line with said valve means wide opened and said head, said valve means in said fuel line intercommunicating between said fuel reservoir and said ultrasonic atomizer comprising a stop valve, and a flow control valve with a main passage and an auxiliary passage, whereby said liquid fuel supply system may be selectively switched to a first supply mode in which said stop valve is wide opened and both said main and auxiliary passages in said control valve also are wide opened or to a second supply mode in which said stop valve is wide opened while only said auxiliary passage in said control valve is opened.

22. A combustion device as set forth in claim 21 wherein the ignition is started by a second fuel supply operation and a predetermined interval of time after ignition of said fuel supply system is switched to a first fuel supply operation.

* * * * *

UNITED STATES PATENT OFFICE

CERTIFICATE OF CORRECTION

Patent No. 4,081,233 Dated March 28, 1978

Inventor(s) Soichi Kitajima, et al

It is certified that error appears in the above-identified patent and that said Letters Patent are hereby corrected as shown below:

"FIG. 1" and "FIG. 2" should be labelled --PRIOR ART--.

In Figure 13, there should be a line extending from "72" into the flame.

Column 1, line 44: "exhanger" should be --exchanger--.

Column 4, line 13: "veiw" should be --view--.

Column 5, line 3: Delete "the" (second occurrence).

line 5: Delete "the" (both occurrences).

line 6: Delete "the".

line 10: "the" should be --a--.

line 32: "the tan-" should be --a tan- --.

line 41: "and the" should be --and--.

line 43: "the" should be --a--.

line 60: "the spark" should be --spark--

Column 6, line 4: "greater" should be --great--.

UNITED STATES PATENT OFFICE

CERTIFICATE OF CORRECTION

Patent No. 4,081,233 Dated March 28, 1978

Inventor(s) Soichi Kitajima, et al

It is certified that error appears in the above-identified patent and that said Letters Patent are hereby corrected as shown below:

Column 10, line 16, in equation 3: Delete the parentheses.

line 20, in equation 4: Delete the parentheses in the first half of the equation.

lines 30 and 51: "overcomed" should be --overcome--.

Column 11, line 21: "time" should be --predetermined time--.

Column 12, line 47: "wich" should be --which--.

Column 14, line 11: "opend" should be --opened--.

line 16: "thereform" should be --therefrom--.

line 32: "form" should be --from--.

Column 15, line 54: "substnatially" should be --substantially--.

UNITED STATES PATENT OFFICE

CERTIFICATE OF CORRECTION

Patent No. 4,081,233 Dated March 28, 1978

Inventor(s) Soichi Kitajima, et al

It is certified that error appears in the above-identified patent and that said Letters Patent are hereby corrected as shown below:

Column 17, line 13: "he" should be --the--.

Column 18, line 48: "coplaner" should be --coplanar--.

Signed and Sealed this

Fourteenth Day of November 1978

[SEAL]

Attest:

RUTH C. MASON
Attesting Officer

DONALD W. BANNER
Commissioner of Patents and Trademarks